US011939774B2

(12) United States Patent
Chapel et al.

(10) Patent No.: US 11,939,774 B2
(45) Date of Patent: Mar. 26, 2024

(54) DEVICE FOR SECURING A PANEL IN A GROOVE BY TIGHTENING WEDGES ARRANGED ON ONE SIDE OF THE PANEL

(71) Applicant: SB INGENIERIE (SAS), Poisy (FR)

(72) Inventors: Romain Chapel, Saint Sylvestre (FR); Léandre Rouif, Croisy (FR); Sylviane Giacometti, Choisy (FR)

(73) Assignee: SB INGENIERIE (SAS), Poisy (FR)

( * ) Notice: Subject to any disclaimer, the term of this patent is extended or adjusted under 35 U.S.C. 154(b) by 251 days.

(21) Appl. No.: 17/508,242

(22) Filed: Oct. 22, 2021

(65) Prior Publication Data

US 2022/0127856 A1 Apr. 28, 2022

(30) Foreign Application Priority Data

Oct. 22, 2020 (FR) ..... 2010860

(51) Int. Cl.
*E04F 11/18* (2006.01)

(52) U.S. Cl.
CPC ..... *E04F 11/1812* (2013.01); *E04F 11/1853* (2013.01); *E04F 2011/1895* (2013.01)

(58) Field of Classification Search
CPC ..... E04F 11/1812; E04F 11/1817; E04F 11/1851; E04F 11/1853; E04F 2011/1823
See application file for complete search history.

(56) References Cited

U.S. PATENT DOCUMENTS 4,680,903 A * 7/1987 Horgan, Jr. ..... E06B 3/5409 52/766
7,730,682 B2 * 6/2010 Nash ..... E06B 3/5454 52/800.18
8,181,405 B2 * 5/2012 Nash ..... E04F 11/1851 52/800.18
9,617,736 B2 * 4/2017 Zhou ..... E04F 11/1812
9,657,760 B2 * 5/2017 Giacometti ..... F16B 5/0685
10,718,117 B2 * 7/2020 Noble ..... E04F 11/1834
10,830,264 B2 * 11/2020 Dagand ..... F16B 2/14
10,876,297 B1 * 12/2020 Poma ..... E04F 11/1812
11,053,688 B2 * 7/2021 Ravan ..... E04F 11/1853
(Continued)

FOREIGN PATENT DOCUMENTS

EP 2479357 A1 7/2012
EP 3323958 A1 5/2018
(Continued)

OTHER PUBLICATIONS

France Search Report dated Jul. 7, 2021, issued in priority French Application No. FR2010860, filed Oct. 22, 2020, 7 pages.

*Primary Examiner* — Jonathan P Masinick
(74) *Attorney, Agent, or Firm* — Christensen O'Connor Johnson Kindness PLLC

(57) ABSTRACT

A device for securing a panel in a groove is provided. The securing device includes a cradle housed in the groove comprising a sole bearing on the bottom of the groove and a vertical outer flange interposed transversely between an outer face of the panel and a face of the groove; a first upper wedge which is interposed between a fixed upper ramp of the groove and an inner face of the panel; and a second lower wedge which is interposed transversely between a fixed lower ramp of the groove and the inner face of the panel. The lower ramp is carried by an inner vertical flange of the cradle.

14 Claims, 5 Drawing Sheets

(56) References Cited

U.S. PATENT DOCUMENTS

| | | | | |
|---|---|---|---|---|
| 11,156,000 | B2 * | 10/2021 | Noble | E04F 11/1851 |
| 11,187,323 | B2 * | 11/2021 | Sprague | F16J 15/0818 |
| 2010/0307082 | A1 | 12/2010 | Nash | |
| 2013/0248792 | A1 * | 9/2013 | Bangratz | E04F 11/1851 256/24 |
| 2015/0110552 | A1 * | 4/2015 | Yang | E04F 11/1812 403/374.1 |
| 2016/0298375 | A1 * | 10/2016 | Wagner | E04F 11/1853 |
| 2017/0101784 | A1 * | 4/2017 | Gonzato | E04F 11/1853 |
| 2019/0177973 | A1 * | 6/2019 | Mitrovic | E04B 2/7401 |
| 2022/0195734 | A1 * | 6/2022 | Giacometti | E04F 11/1812 |

FOREIGN PATENT DOCUMENTS

| | | | |
|---|---|---|---|
| EP | 3372748 | A1 | 12/2018 |
| WO | 2020239670 | A1 | 3/2020 |

* cited by examiner

DEVICE FOR SECURING A PANEL IN A GROOVE BY TIGHTENING WEDGES ARRANGED ON ONE SIDE OF THE PANEL

CROSS-REFERENCE TO RELATED APPLICATION

This application claims priority to FR 2010860, filed Oct. 22, 2020, the disclosure of which is hereby expressly incorporated by reference herein in its entirety.

TECHNICAL FIELD

The present disclosure relates to examples of a device for securing a vertical panel in a longitudinal groove. The panel is delimited transversely, in the direction of its thickness, by an inner vertical face and by an outer vertical face. The securing device may comprise a cradle which is intended to be housed in the groove and tightening wedges of the panel which are intended to be interposed solely between the inner face of the panel and an inner lateral face of the groove.

BACKGROUND

It is known that guardrails are made by securing a vertical panel in the groove of a rail. Such a panel is made of glass, for example.

Typically, the positioning and securing of a guardrail panel in the groove is achieved by inserting a wedge on one side of the panel. The panel is then tight against an opposite side of the groove by pushing in the wedge.

Such an arrangement in which the tightening is carried out unilaterally, i.e., from one side only, is particularly in demand when the panel is only easily accessible from one side, the so-called inner side. This is, in particular, the case when the guardrail is arranged at an altitude, in which the outer side opens onto the void.

Such an arrangement comprising only one tightening wedge does not allow for a strong securing.

One of the aims of disclosed subject matter is to obtain a strong securement, from one side of the panel only, by a device which is simple and inexpensive to manufacture.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with embodiments of the disclosure, a device is provided for securing a vertical panel in a longitudinal groove. The panel can be delimited transversely, in the direction of its thickness, by an inner vertical face and by an outer vertical face. In an embodiment, the securing device includes one or more of the following:

- a cradle which is intended to be housed in the groove and which comprises a sole bearing on the bottom of the groove and a vertical outer flange which is intended to be interposed transversely between the outer face of the panel and an outer lateral face of the groove; and
- means for tightening the panel which are intended to be interposed solely between the inner face of the panel and an inner lateral face of the groove.

In an embodiment, the tightening means includes a first upper wedge which is transversely interposed between a first fixed upper ramp of the inner lateral face of the groove and the inner face of the panel, and a second lower wedge which is arranged below the first upper wedge and which is transversely interposed between a second fixed lower ramp of the inner lateral face of the groove and the inner face of the panel. In some embodiments, each wedge is received vertically slidable in the groove from a released position to a tight position. In some embodiments, the lower ramp is carried by an inner vertical flange of the cradle which is intended to be interposed transversely between the inner lateral face of the groove and the lower wedge.

According to another embodiment of the disclosure, the upper ramp is formed integrally with the inner lateral face of the groove.

According to another embodiment of the disclosure, the outer flange of the cradle is intended to bear flat against the outer face of the panel.

According to another embodiment of the disclosure, the outer flange of the cradle bears flat against the flat vertical outer face of the groove.

According to another embodiment of the disclosure, the outer flange is directly in contact with the outer face of the panel.

According to another embodiment of the disclosure, the cradle is made of a single piece of rigid plastic.

According to another embodiment of the disclosure, the lower wedge and the upper wedge are controlled towards their tight position by moving towards each other along their vertical sliding direction.

According to another embodiment of the disclosure, the lower ramp has an inclination with respect to the vertical direction so as to be turned towards the bottom of the groove.

According to another embodiment of the disclosure, the lower wedge and the upper wedge are controlled between their released and tight positions by at least one common control screw.

According to another embodiment of the disclosure, the cradle is intended to be immovably housed in the groove.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Moreover, some of the method steps can be carried serially or in parallel, or in any order unless specifically expressed or understood in the context of other method steps.

In the remainder of the description, the longitudinal, vertical, and transverse orientations indicated by the frame "L, V, T" in the figures will be adopted in a non-limiting way.

Figure 1:
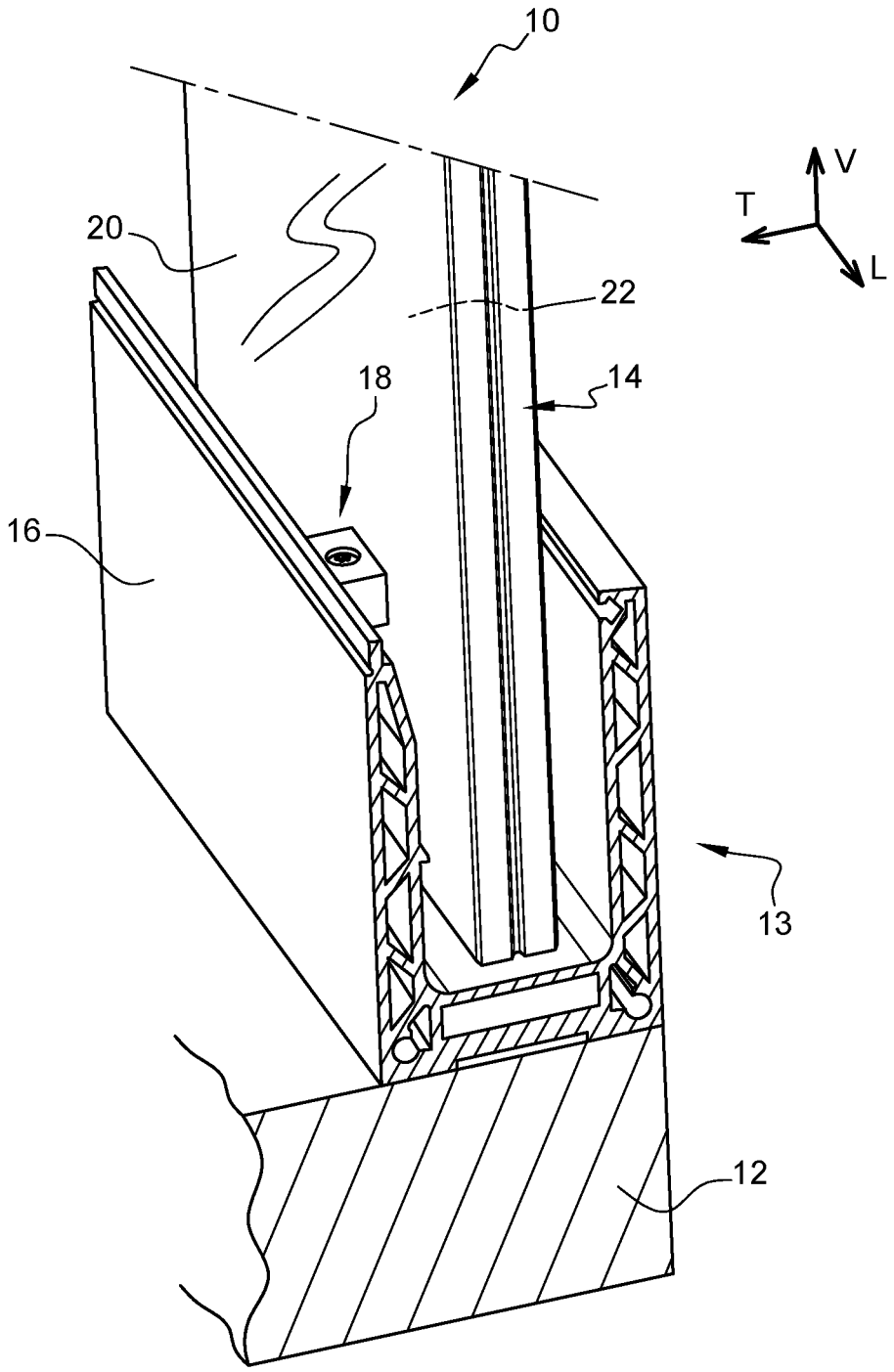
FIG. 1 is a perspective view showing a panel secured in a rail mounted on the border of a concrete slab, the panel being secured by a securing device made in accordance with the teachings of the disclosure.

FIG. 1 shows a guardrail 10 which is mounted at the border of a slab 12, for example a concrete slab. The border of the slab 12 is not easily accessible, for example it is arranged at an altitude. The guardrail 10 comprises a vertical panel 14 and an assembly 13 for securing the panel 14. In an embodiment, the panel 14 is made of glass.

As shown in FIG. 1, the securing assembly 13 comprises a rail 16 for supporting the panel 14. The securing assembly 13 also comprises at least one device 18 for securing the panel 14 in the rail 16. The panel 14 may be held vertically in the support rail 16 by several securing devices 18 which are distributed along the length of the rail 16; however, only a section of rail 16 with a single securing device 18 is shown in FIG. 1. Each securing device 18 is designed to allow the panel 14 to be firmly secured in a vertical position and to withstand very high loads. As the securing devices 18 are identical, only one of these devices 18 will be described in detail below for brevity, the description being applicable to the other securing devices 18 as well.

The panel 14 is delimited transversely in the direction of the thickness by an inner face 20 which faces the accessible side of the rail 16, and by an outer face 22 which faces the inaccessible side of the rail 16. The panel 14 in the mounted position thus divides the space into an accessible inner side 24 and an inaccessible outer side 26. For the remainder of the description and in the claims, elements located on the inner side of the panel 14 will be referred to as "inner", while elements located on the outer side will be referred to as "outer".

Figure 2:
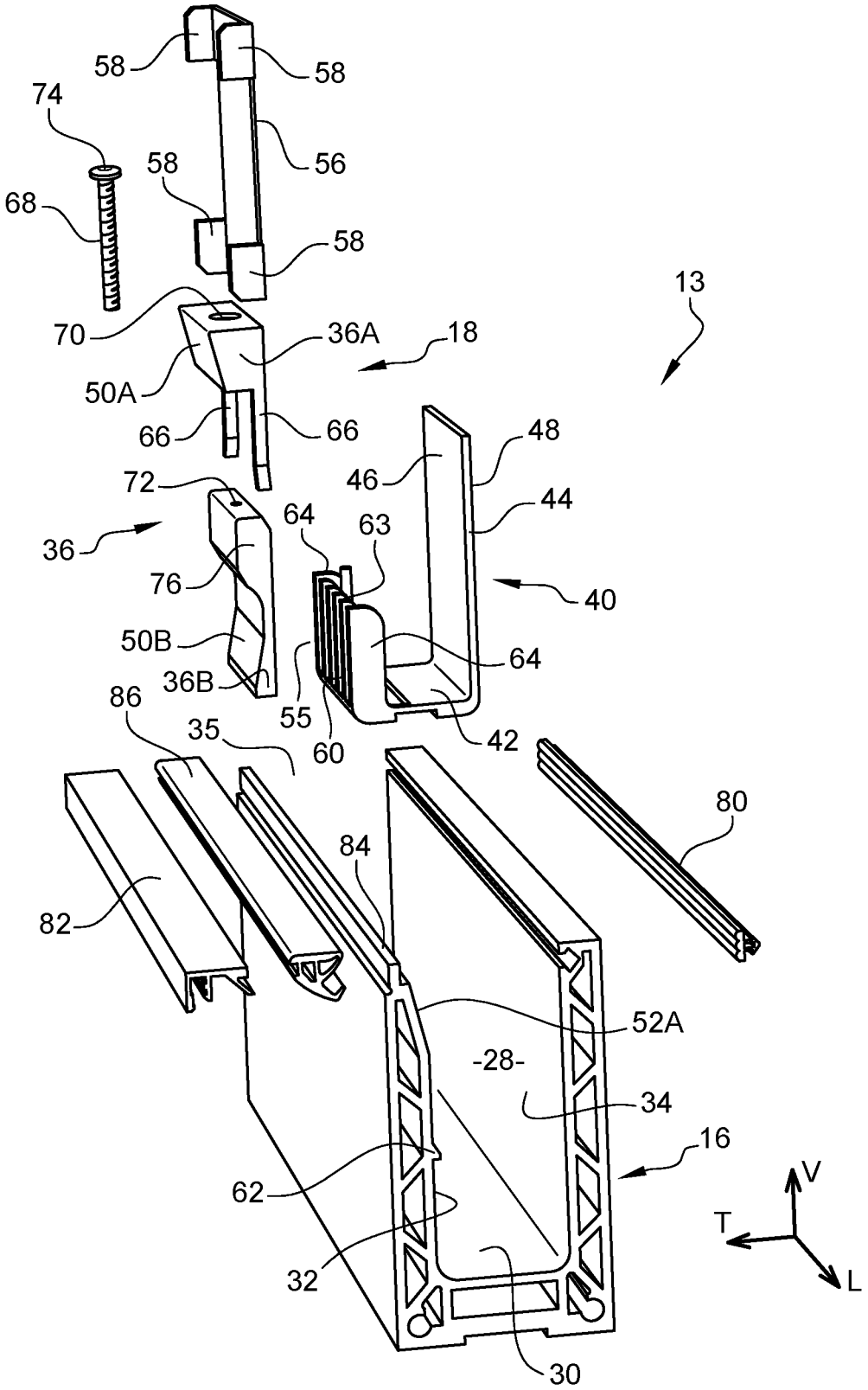
FIG. 2 is an exploded perspective view showing the rail and a securing device of FIG. 1.
Figure 3:
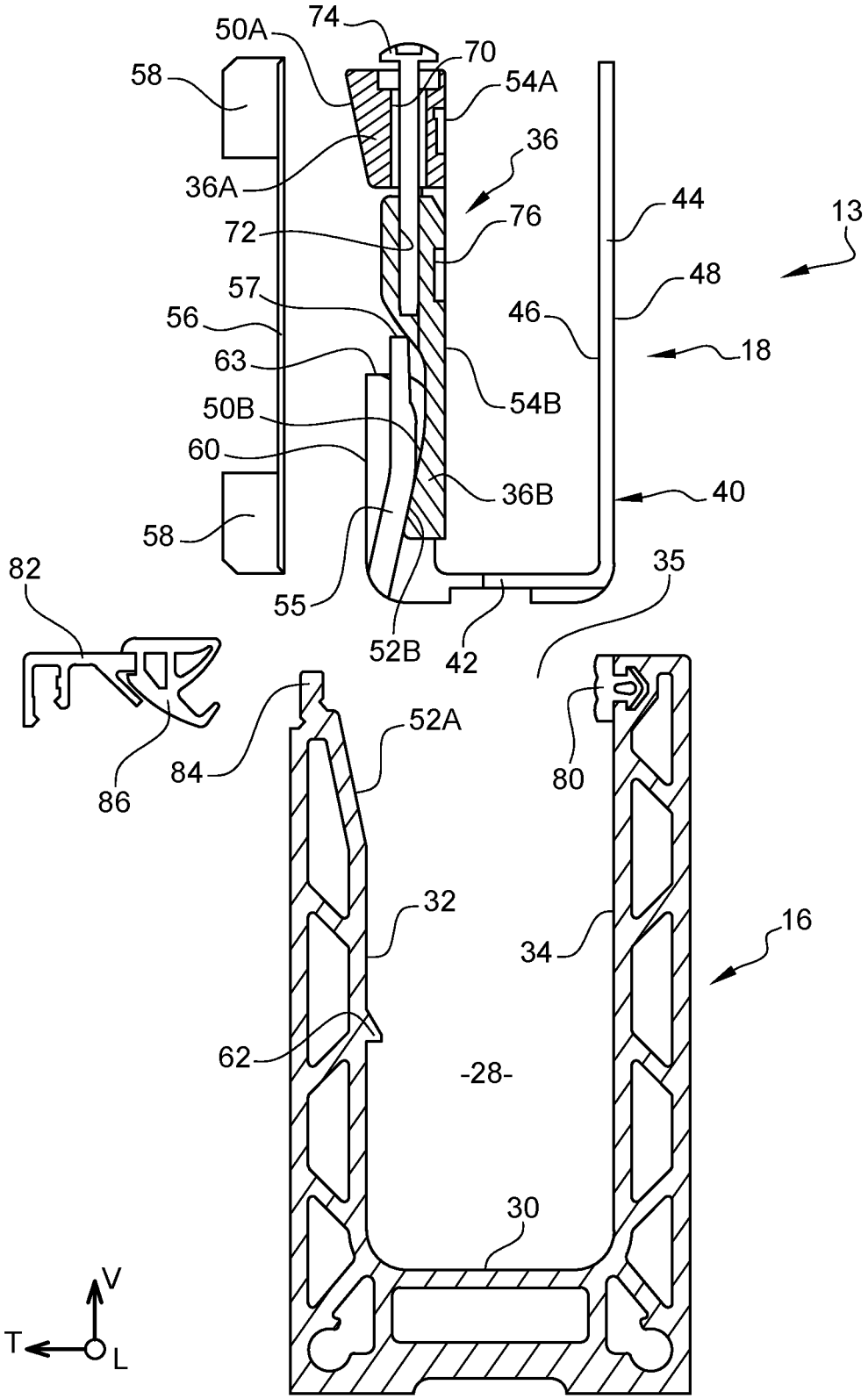
FIG. 3 is a cross-sectional view along a vertical cross-sectional plane passing through the centre of the tightening wedges provided in the securing device and showing the rail and the securing device of FIG. 2.

As illustrated in more detail in FIGS. 2 and 3, the support rail 16 is formed, for example, by an aluminium profile. The rail 16 has a "U"-shaped cross-section delimiting a groove 28 for receiving the panel 14 and the securing device 18. The support rail 16 extends continuously in the longitudinal direction. The support rail 16 is intended to be secured to the slab 12 prior to mounting the panel 14.

When viewed from the side, the groove 28 is "U" shaped. It is delimited at the bottom by a horizontally flat bottom 30. It is delimited transversely by an inner lateral face 32, on the one hand, and by an outer lateral face 34, on the other hand, which are arranged transversely opposite each other. The groove 28 has an upper opening 35. The width of the groove 28 between the inner face 32 and the outer face 34 is greater than the thickness of the panel 14. The inner face 32 is located on the inner side 24, while the outer side 34 is located on the outer side 26.

The securing device 18 comprises means 36 for tightening the panel 14 which are intended to be interposed solely between the inner face 20 of the panel 14 and the inner lateral face 32 facing the groove 28. The tightening means 36 comprise an upper wedge 36A and a lower wedge 36B. Each wedge 36A, 36B may be made, for example, of a rigid plastic material. In some embodiments, each wedge 36A, 36B is made in a single piece, for example by moulding.

Figure 4:
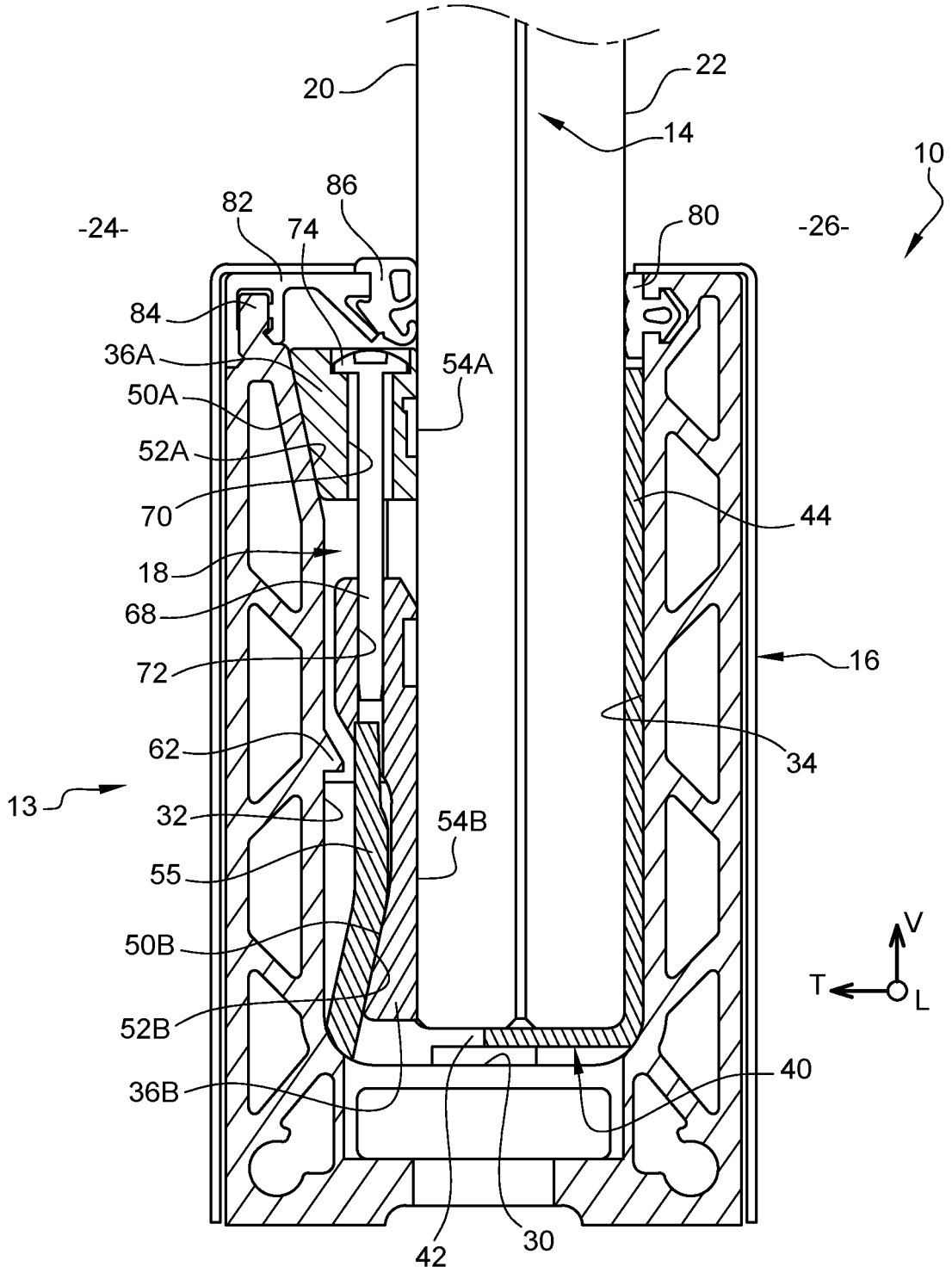
FIG. 4 is a cross-sectional view according to the same cross-sectional plane as FIG. 3, showing the panel which is mounted tight in a groove in the rail by a securing device of the disclosure.

As shown in FIG. 4, no tightening wedge(s) is provided between the outer face 22 of the panel 14 and the outer lateral face 34 of the groove 28.

Figure 5:
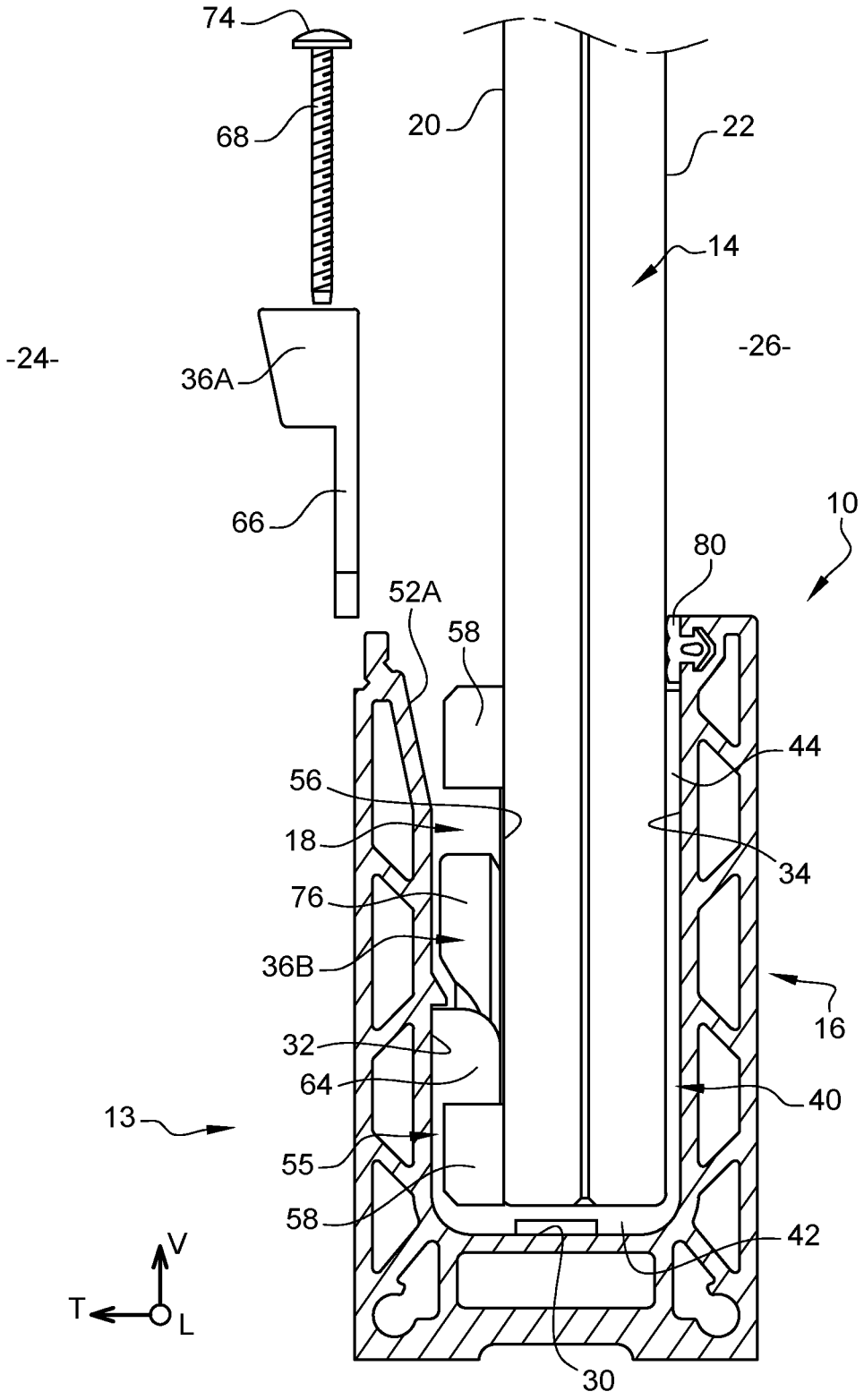
FIG. 5 is a side view showing the panel being secured in the rail by the securing device of the disclosure.

The securing device 18 may also comprise a cradle 40 which is intended to be housed in the groove 28. The cradle 40 comprises a horizontal sole 42 which is intended to bear flat against the bottom 30 of the groove 28. The cradle 40 also comprises an outer flange 44 which extends vertically from an outer end edge of the sole 42. Thus, in cross-section, as shown in FIG. 3, the sole 42 and the outer flange 44 form an "L". The outer flange 44 is intended to be interposed transversely between the outer face 22 of the panel 14 and the outer lateral face 34 opposite the groove 28, as shown in FIGS. 4 and 5.

The outer flange 44 is in the form of a flat plate. Thus, the outer flange 44 has an internal face 46, facing the outer face 22 of the panel 14, which is flat and extends in a transverse vertical plane. The outer flange 44 is here directly in contact with the outer face of the panel.

The outer flange 44 also has an outer face 48 opposite the internal face 46. The outer face 48 is flat and extends in a transverse vertical plane. The inner lateral face 34 of the groove 28 has a flat shape extending in a transverse vertical plane from the bottom 30 to the opening 35 so that the outer face 48 of the outer flange 44 bears flat against the inner lateral face 34 of the groove 28. The outer flange 44 is here directly in contact with the outer face 22 of the panel 14.

The cradle 40 in some embodiments is of rigid plastic material. The cradle 40 can be made in a single piece, for example by moulding.

The upper wedge 36A of the securing device 18 is interposed between the inner lateral face 32 of the groove 28 and the inner face 20 of the panel 14, as illustrated in FIG. 4. A first upper ramp 52A is securely arranged on the inner lateral face 32 of the groove 28. The upper wedge 36A is interposed between the first upper ramp 52A and the inner face 20 of the panel 14. The upper wedge 36A comprises an inclined face 50A which is intended to cooperate with the first upper ramp 52A to allow its tightening between the panel 14 and the upper ramp 52A by sliding vertically downwards. In this regard, the first upper ramp 52A is inclined with respect to the vertical so as to face upwards, while the inclined face 50A of the upper wedge 36A is inclined with respect to the vertical so as to face downwards.

In the examples shown in the figures, the first upper ramp 52A is formed integrally with the inner lateral face 32 of the groove 28. In the example shown in the figures, the upper ramp 52A is therefore formed integrally with the rail 16. In some embodiments, the inner face 32 of the groove 28 has an upper longitudinal strip in a bevelled shape.

The second lower wedge 36B is arranged below the first upper wedge 36A. The second lower wedge 36B is transversely interposed between the inner lateral face 32 of the groove 28 and the inner face 20 of the panel 14, as illustrated in FIGS. 4 and 5. A second lower ramp 52B is securely arranged on the inner lateral face 32 of the groove 28. The lower wedge 36B is interposed between the second lower ramp 52B and the inner face 20 of the panel 14. The lower wedge 36B comprises an inclined face 50B which is intended to cooperate with the second lower ramp 52B to allow its tightening between the panel 14 and the lower ramp 52B by sliding the lower wedge 36B vertically upwards. In this respect, the second lower ramp 52B has an inclination with respect to the vertical so as to face downwards and overhang with respect to the bottom 30 of the groove 28, whereas the inclined face 50B of the lower wedge 36B is inclined with respect to the vertical so as to face upwards.

The lower ramp 52B is carried by an inner flange 55 of the cradle 40. The outer flange 55 extends vertically from an inner end edge of the sole 42. The inner flange 55 is intended to be transversely interposed between the inner face 20 of the panel 14 and the inner lateral face 32 opposite the groove 28. In some embodiments, the inner flange 55 bears against the inner lateral face 32 of the groove 28. The inner flange 55 does not extend to the top of the inner lateral face 32. It is delimited by an upper edge 57 which is arranged below the level of the upper ramp 52A, here substantially halfway up the groove 28.

Each wedge 36A, 36B is received vertically slidably in the groove 28 from a released position to a tight position. Each wedge 36A, 36B comprises a tightening face 54A, 54B which is intended to be tight against the panel 14. Each tightening face 54A, 54B extends in a vertical plane. The tightening faces 54A, 54B may be tight directly against the inner face 20 of the panel 14.

However, it is also possible to interpose a shim 56 between the wedges 36A, 36B and the panel 14, as shown in FIGS. 3 and 5. In some embodiments, the shim 56 is common to both wedges 36A, 36B. The shim 56 is in the form of a vertical longitudinal plate. It comprises fins 58 which extend outwards from each longitudinal end edge. The fins 58 cooperate with sides of the upper wedge 36A and sides of the inner flange 55 of the cradle 40 to hold the shim 56 longitudinally in position in the groove 28.

In the tight position, each wedge 36A, 36B is tight transversely between the inner lateral face 32 of the groove 28 and the inner face 20 of the panel. In some embodiments, sliding of the upper wedge 36A from its released position to its tight position takes place vertically downward, while the sliding of the lower wedge 36B from its released position to its tight position takes place vertically upward. In the tight position, a majority of the tightening force is directed transversely towards the panel 14, with the wedges 36A, 36B bearing against their respective ramps 52A, 52B.

In the tight position, the lower wedge 36B also tightens the inner flange 55 of the cradle 40 against the inner lateral face 32 of the groove 28. In some embodiments, the internal flange 55 has ribs 60 which extend behind the lower ramp 52B towards the inner lateral face 32 of the groove 28 to form a solid support to prevent deformation of the lower ramp 52B under the transverse tightening force.

When the lower wedge 36B is slid vertically upwards, a minority of the tightening force is directed in a vertical direction which tends to raise the cradle 40 with respect to the bottom 30. To prevent this from happening, the inner lateral face 32 of the groove 28 is provided with a projecting longitudinal lug 62 against which a stop face 63 of the inner flange, here formed by an upper face of the ribs 60, comes to bear vertically to hold the sole 42 of the cradle 40 in contact with the bottom 30 of the groove 28. Thus, the lower ramp 52B remains secured with respect to the inner lateral face 32 of the groove 28.

The vertical sliding of the lower wedge 36B is guided with respect to the cradle 40 of the vertical transverse flasks 64 which are arranged longitudinally on either side of the lower ramp 52B. In addition, the vertical sliding of the upper wedge 36A is guided relative to the lower wedge 36B by two tabs 66 which extend vertically downwards from a lower face of the upper wedge 36A. The tabs 66 embrace the lower wedge 36B longitudinally. To ensure contact between the longitudinal end sides of the lower wedge 36B and the tabs 66, the tabs are resiliently flexed against said sides of the lower wedge 36B. These tabs 66 ensure a vertical alignment of the two wedges 36A, 36B.

The sliding of the upper wedge 36A and that of the lower wedge 36B is achieved simultaneously by common control means, which may include an actuator such as a screw. Thus, the two wedges 36A, 36B are simultaneously controlled towards their tight positions by moving towards each other in the vertical direction. The assembly formed by the two wedges 36A, 36B linked by their common control means is thus mounted floating vertically in the groove 28, in the released position of the wedges 36A, 36B, so that when tightening the wedges 36A, 36B, the tightening force exerted by each of the wedges 36A, 36B against the panel 14 is automatically balanced.

The control means in some embodiments are formed by at least one vertical axis control screw 68. The lower wedge 36B and the upper wedge 36A are here controlled between their released and tight positions by a single common control screw 68. The control screw 68 is received in an associated smooth hole 70 in the upper wedge 36A in line with the lower wedge 36B. The lower end of the control screw 68 is screwed into engagement with the lower wedge 36A, for example into an internal thread 72 of the lower wedge 36B. The tabs 66 ensure vertical alignment of the smooth hole 70 and the internal thread 72.

The internal thread 72 of the lower wedge 36B is, for example, formed in an upper end head 76 of the wedge 36B which is arranged above the tightening face 50B.

Thus, when the screw 68 is screwed in, the lower wedge 36A, locked in rotation by the cradle 40 and the panel 14, slides up to a tight position in which it is wedged between the lower ramp 52B and the panel 14. Simultaneously, a head 74 of the control screw 68 bears on the upper wedge 36A to slide it downwards until it is wedged between the inner lateral face 32 of the groove 28 and the panel 14. The screwing action can be continued until the inner wedges 36A, 36B are tight with the desired screwing force to obtain the vertical securing of the panel 14 with a corresponding tightening force.

In addition to the quick securing, this system of simultaneously tightening the upper inner wedge 36A and the lower inner wedge 36B with the same control screw 68 allows the tightening force applied by each inner wedge 36A, 36B against the panel 14 to be balanced.

When the guardrail 10 is installed, the rail 16 is first secured to the floor 12. The cradle 40 is then housed into the groove 28 with the lower wedge 36B in position between the flasks 64, as shown in FIG. 5. The panel 14 is then inserted into the groove 28. A lower edge 78 of the panel 14 bears on the sole 42 of the cradle which is then pressed against the bottom 30 of the groove 28 by the very heavy weight of the panel 14.

Due to the shape of the cradle 40, and, for example, its flat sole 42, the cradle 40 is immovably housed in the groove 28. This means, for example, that the cradle 40 cannot pivot relative to the groove 28 about a longitudinal axis.

A longitudinal outer seal 80 is provided which borders the upper opening 35 of the groove 28. The outer seal 80 prevents the panel 14 from coming into direct contact with the rail 16. The seal 80 is for example made of an elastomeric material. It is secured to the outer lateral face 34 of the groove 28, for example by fitting into a mortise.

The outer seal 80 has a transverse thickness which is slightly greater than the thickness of the outer flange 44.

Thus, when the panel 14 bears against the outer lateral face 34 with the outer flange 44 interposed, the seal 44 is used to fill the gap present between the outer edge of the upper opening 35 of the groove 28 and the panel 14, for example to prevent water from entering the groove 28. However, the outer seal 80 has a sufficiently small thickness that it does not influence the vertical position of the panel 14 in the groove 28.

Optionally, the shim 56 can then be inserted into the groove 28 between the panel 14 and the lower wedge 36B, when the thickness of the panel 14 requires the use of such a shim 56.

As shown in FIG. 4, the upper wedge 36A is then positioned in the groove 28 above the lower wedge 36B. The positioning is facilitated by the presence of the guide tabs 66. The shim 56 is inserted between the wedges 36A, 36B and the inner face 20 of the panel 14.

The control screw 68 is then inserted into the smooth hole 70 of the upper wedge 36A and then screwed into the internal thread 72 of the lower wedge 36B. As the control screw 68 is screwed in, for example with a screwdriver, the two wedges 36A, 36B move vertically towards each other, causing them to slide into their tight position. This causes the panel 14 to bear against the outer lateral face 34 of the groove 28, tightening the outer flange 44 of the cradle 40. The panel 14 is held upright and vertical by tightening against the vertical outer lateral face 34 of the groove 28. Due to the geometry of the outer flange 44, the vertical position of the panel 14 is defined as being parallel to the outer lateral face 34 of the groove 28.

At the end of the screwing operation, a gap remains between an inner edge of the upper opening 35 of the groove 28 and the inner face 20 of the panel 14, due to the presence of the upper ramp 52A and the presence of the wedges 36A, 36B. To close this gap, a cover 82 is provided which is intended to be interlocked with a longitudinal tenon 84 of the rail 16. A transverse end edge of the cover 82 is provided with a seal 86 which is intended to come into contact with the inner face 20 of the panel 14 to ensure the watertight seal of the groove 28.

Embodiments of the disclosure thus enables a panel 14 of a guardrail 10 to be secured in a rail 16 from the inner side only by a simple and inexpensive securing device 18 to be manufactured. The securing device 18 with two wedges 36A, 36B provides a particularly strong hold of the panel 14. In addition, the securing device 18, having a cradle 40 provided with a ramp 52B, allows the tightening of the lower wedge 36B while providing a rail geometry 16 that is relatively simple and inexpensive to manufacture.

In the foregoing description, specific details are set forth to provide a thorough understanding of representative embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

It should be noted that for purposes of this disclosure, terminology such as "upper," "lower," "vertical," "horizontal," "fore," "aft," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

Throughout this specification, terms of art may be used. These terms are to take on their ordinary meaning in the art from which they come, unless specifically defined herein or the context of their use would clearly suggest otherwise The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the disclosure in which an exclusive property or privilege is claimed are defined as follows:

1. A device for securing a vertical panel in a longitudinal groove, the panel being delimited transversely, in the direction of its thickness, by an inner vertical face and by an outer vertical face, the securing device comprising:

a cradle intended to be housed in the groove, the cradle comprising a sole for bearing on the bottom of the groove, a vertical outer flange intended to be interposed transversely between the outer face of the panel and an outer lateral face of the groove, and a vertical inner flange having a lower ramp surface;

means for tightening the panel, the means for tightening the panel configured to be interposed solely between the inner face of the panel and an inner lateral face of the groove, the means for tightening comprising:

an upper wedge transversely interposed between an upper ramp surface of the inner lateral face of the groove and the inner face of the panel; and a lower wedge arranged below the upper wedge and transversely interposed between the lower ramp surface of the cradle and the inner face of the panel;

wherein each wedge is received vertically slidable in the groove from a released position to a tight position;

wherein the vertical inner flange of the cradle is intended to be interposed transversely between the inner lateral face of the groove and the lower wedge.

2. The securing device according to claim 1, wherein the upper ramp is formed integrally with the inner lateral face of the groove.

3. The securing device according to claim 1, wherein the outer flange of the cradle is intended to bear flat against the outer face of the panel.

4. The securing device according claim 1, wherein the outer flange of the cradle bears flat against the flat vertical outer face of the groove.

5. The securing device according to claim 1, wherein the outer flange is directly in contact with the outer face of the panel.

6. The securing device according to claim 1, wherein the cradle is made of a single piece of rigid plastic.

7. The securing device according to claim 1, wherein the lower wedge and the upper wedge are controlled towards their tight position by moving towards each other along their vertical sliding direction.

8. The securing device according to claim 7, wherein the lower ramp has an inclination with respect to the vertical direction so as to be turned towards the bottom of the groove.

9. The securing device according to claim 7, wherein the lower wedge and the upper wedge are controlled between their released and tight positions by at least one common control screw.

10. The securing device according to claim 1, wherein the cradle is intended to be immovably housed in the groove.

11. The securing device according to claim 1, wherein the groove has a longitudinal axis, and wherein the outer flange of the cradle extends upwardly from the sole of the cradle to a position on or past a plane that is orthogonal to the longitudinal axis of the grove and that intersects with the upper ramp surface of the inner lateral face of the groove.

12. The securing device according to claim 11, wherein the outer flange of the cradle bears flat against the flat vertical outer face of the groove.

13. The securing device according to claim 1, wherein the upper ramp surface of the inner lateral face of the groove has a lower end and an upper end, the lower end disposed closer in proximity to the bottom of the groove than the upper end, and wherein the outer flange of the cradle extends upwardly from the sole of the cradle to a position in-between the lower end of the upper ramp surface and the upper end of the upper ramp surface.

14. The securing device according to claim 13, wherein the outer flange of the cradle bears flat against the flat vertical outer face of the groove.

* * * * *